US011434612B2

(12) United States Patent
Rodden et al.

(10) Patent No.: US 11,434,612 B2
(45) **Date of Patent: *Sep. 6, 2022**

(54) CONCRETE SLAB LOAD TRANSFER APPARATUS AND METHOD OF MANUFACTURING SAME

(71) Applicant: Illinois Tool Works Inc., Glenview, IL (US)

(72) Inventors: Robert Alan Rodden, Atlanta, GA (US); Zafar Imtiaz Ali, Tinley Park, IL (US); Matthew Douglas St. Louis, Concord, NC (US); Randall Derek Riffle, Lake Villa, IL (US); Eddie Kao, Skokie, IL (US); Jimmy Lee Hall, Kannapolis, NC (US)

(73) Assignee: Illinois Tool Works Inc., Glenview, IL (US)

( * ) Notice: Subject to any disclaimer, the term of this patent is extended or adjusted under 35 U.S.C. 154(b) by 89 days.

This patent is subject to a terminal disclaimer.

(21) Appl. No.: 17/092,902

(22) Filed: Nov. 9, 2020

(65) Prior Publication Data

US 2021/0054578 A1 Feb. 25, 2021

Related U.S. Application Data

(63) Continuation of application No. 16/279,368, filed on Feb. 19, 2019, now Pat. No. 10,837,144.

(Continued)

(51) Int. Cl.
*E01C 11/14* (2006.01)
*E04B 1/48* (2006.01)

(Continued)

(52) U.S. Cl.
CPC ..... *E01C 11/14* (2013.01); *E01C 11/06* (2013.01); *E04B 1/483* (2013.01); *E04B 5/32* (2013.01);

(Continued)

(58) Field of Classification Search
CPC ..... E01C 11/14; E01C 11/06; E04B 1/483; E04B 5/32; E04B 2103/02; E04C 5/0604; E04C 5/163
See application file for complete search history.

(56) References Cited

U.S. PATENT DOCUMENTS 1,436,896 A 11/1922 Newell
1,863,115 A 6/1932 Heltzel (Continued)

FOREIGN PATENT DOCUMENTS

ES 2 149 103 10/2000
KR 101 520 853 5/2015

(Continued)

OTHER PUBLICATIONS

PD³ Basket Assembly, product data sheet, PNA™ Construction Technologies, published Jan. 2010 (2 pages).

(Continued)

*Primary Examiner* — Abigail A Risic
(74) *Attorney, Agent, or Firm* — Neal, Gerber & Eisenberg LLP

(57) ABSTRACT

Various embodiments of the present disclosure provide a cast-in-place concrete slab load transfer apparatus and method of manufacturing same. In various embodiments, the concrete slab load transfer apparatus includes a plurality of load transfer dowels each having a top surface and a bottom surface, a basket supporting the load transfer dowels, and a plurality of welds including a plurality of breakable welds connecting the bottom surfaces of the load transfer dowels to the basket.

19 Claims, 11 Drawing Sheets

Related U.S. Application Data

(60) Provisional application No. 62/640,901, filed on Mar. 9, 2018.

(51) Int. Cl.

| | |
|---|---|
| ***E01C 11/06*** | (2006.01) |
| ***E04C 5/06*** | (2006.01) |
| ***E04C 5/16*** | (2006.01) |
| ***E04B 5/32*** | (2006.01) |

(52) U.S. Cl.
CPC ..... *E04C 5/0604* (2013.01); *E04C 5/163* (2013.01); *E04B 2103/02* (2013.01)

(56) References Cited

U.S. PATENT DOCUMENTS

| | | | | |
|---|---|---|---|---|
| 1,991,931 | A | 2/1935 | Kling et al. | |
| 2,319,050 | A | 5/1943 | Fischer | |
| 2,634,660 | A | 4/1953 | Godwin | |
| 2,783,695 | A | 3/1957 | De Canio | |
| 2,858,748 | A | 11/1958 | Crone | |
| 2,864,289 | A | 12/1958 | De Canio | |
| 3,022,713 | A | 2/1962 | Friberg | |
| 3,033,087 | A | 5/1962 | Bror | |
| 3,059,553 | A | 10/1962 | Woolley | |
| 3,104,600 | A | 9/1963 | White | |
| 3,279,335 | A | 10/1966 | Garner | |
| 3,397,626 | A | 8/1968 | Kornick | |
| 4,653,956 | A | 3/1987 | Lang | |
| 6,092,960 | A | 7/2000 | McCallion | |
| 6,171,016 | B1 * | 1/2001 | Pauls | E01C 11/14 404/62 |
| 6,409,423 | B1 | 6/2002 | Li | |
| 6,447,203 | B1 | 9/2002 | Ruiz | |
| 6,592,289 | B1 | 7/2003 | Weander | |
| 6,688,808 | B2 | 2/2004 | Lee | |
| 6,745,532 | B1 | 6/2004 | Vazquez Ruiz del Arbol | |
| 7,314,334 | B1 | 1/2008 | Bennett | |
| 7,481,031 | B2 | 1/2009 | Boxall et al. | |
| 7,571,581 | B2 | 8/2009 | Covarrubias | |
| 7,637,689 | B2 | 12/2009 | Boxall et al. | |
| 7,716,890 | B2 | 5/2010 | Boxall et al. | |
| 8,381,470 | B2 | 2/2013 | Boxall et al. | |
| 8,511,935 | B1 | 8/2013 | Thomas | |
| 8,627,626 | B2 | 1/2014 | Boxall et al. | |
| 9,561,557 | B2 | 2/2017 | Anagnostopoulos | |
| 2004/0187431 | A1 | 9/2004 | Boxall | |
| 2005/0220539 | A1 | 10/2005 | Yee | |
| 2006/0177268 | A1 | 8/2006 | Kramer | |
| 2006/0177269 | A1 | 8/2006 | Kramer | |
| 2007/0059096 | A1 | 3/2007 | Boxall | |
| 2010/0242401 | A1 | 9/2010 | Boxall et al. | |
| 2013/0209171 | A1 | 8/2013 | Thomas | |
| 2014/0021185 | A1 | 1/2014 | Anagnostopoulos | |
| 2014/0270948 | A1 | 9/2014 | Heady | |
| 2014/0270949 | A1 | 9/2014 | Heady | |
| 2015/0013262 | A1 | 1/2015 | Wilkes et al. | |
| 2015/0110555 | A1 | 4/2015 | Covarrubias Vidal | |
| 2017/0089373 | A1 | 3/2017 | Schulte | |
| 2018/0030669 | A1 * | 2/2018 | Heady | E01C 11/14 |
| 2018/0320373 | A1 | 11/2018 | Rodden | |
| 2018/0347610 | A1 | 12/2018 | Zuk | |
| 2019/0249375 | A1 * | 8/2019 | McDonald | F16B 13/02 |

FOREIGN PATENT DOCUMENTS

| | | |
|---|---|---|
| KR | 2018 0014651 | 2/2018 |
| WO | WO 00/01890 | 1/2000 |
| WO | WO 02/12630 | 2/2002 |

OTHER PUBLICATIONS

Extended European Search Report from European Application No. 19159259.1, dated Jul. 8, 2019 (9 pages).

* cited by examiner

CONCRETE SLAB LOAD TRANSFER APPARATUS AND METHOD OF MANUFACTURING SAME

PRIORITY

This application is a continuation of, and claims priority to and the benefit of U.S. patent application Ser. No. 16/279,368, filed on Feb. 19, 2019, which claims priority to and the benefit of U.S. Provisional Patent Application No. 62/640,901, filed Mar. 9, 2018, the entire contents of each of which are incorporated herein by reference.

BACKGROUND

Concrete substrates (such as floors and roadways) typically include a series of separate individually poured or cast-in-place concrete slabs. Construction joints are typically used to join or are formed at and between such separately individually poured adjacent concrete slabs (i.e., adjacent concrete slabs that are poured at different or sequential times). For example, longitudinally extending construction joints are typically used to form joints between the concrete slabs of adjacent lanes of a roadway. Transverse construction joints are also typically used to join the adjacent transverse ends or transverse vertically extending edges of certain adjacent concrete slabs that are separately individually poured (such as concrete slabs in a single lane of a roadway that are poured on sequential days).

Concrete substrates can also be made up of concrete slabs that are formed from larger concrete slabs that are individually poured or cast-in-place. Such concrete slabs that are formed from such larger concrete slabs are typically made by forming one or more contraction joints in the larger concrete slabs. Contraction joints (which are also sometimes called control joints) are used to control naturally occurring cracking in concrete substrates from stresses caused by concrete shrinkage, thermal contraction, moisture or thermal gradients within the concrete, and/or various external forces on the concrete substrates. Contraction joints are typically formed by vertically cutting the concrete substrates along or at the area of the desired location of the contraction joint. Contraction joints are typically vertically sawed into the concrete and often extend approximately one third of the way through the depth of the concrete. When a larger concrete slab cracks along a contraction joint, the smaller concrete slabs are formed.

The term concrete slab as used herein is meant to include a separately individually poured or cast-in-place concrete slab or a concrete slab formed from a larger concrete slab.

Different types of known dowels are typically used in forming contraction joints. Certain known dowels are used to facilitate load transfers between adjacent concrete slabs. One known concrete slab load transfer apparatus is generally shown in FIG. 1 and indicated by numeral 10. This known concrete slab load transfer apparatus 10 includes: (a) three spaced apart steel planar load transfer dowels 40*a*, 40*b*, and 40*c*; and (b) a steel basket 11 connected to and supporting the planar load transfer dowels 40*a*, 40*b*, and 40*c*.

The basket 11 includes a steel first leg 12 and a spaced apart steel second leg 22. The first leg 12 includes an elongated lower member 14 and an elongated upper member 16. Likewise, the second leg 22 includes an elongated lower member 24 and an elongated upper member 26. The basket 11 includes leg connectors 60 and 62 integrally connected to upper members 16 and 26 thereby connecting the legs 12 and 22. The basket 11 includes: (a) dowel connectors 20*a*, 20*b*, and 20*c* each integrally connected to members 14 and 16; and (b) dowel connectors 30*a*, 30*b*, and 30*c* each integrally connected to members 24 and 26. In this apparatus 10: (a) dowel connector 20*b* is welded to the top of the dowel 40*b*; (b) dowel connector 30*a* is welded to the top of the dowel 40*a*; and (c) dowel connector 30*c* is welded to the top of the dowel 40*c*. However, in this apparatus 10: (a) dowel connector 20*a* is not welded to the top of the dowel 40*a*; (b) dowel connector 20*c* is not welded to the top of the dowel 40*c*; and (c) dowel connector 30*b* is not welded to the top of the dowel 40*b*. Thus, in this apparatus 10, leg connectors 60 and 62 keep the first leg 12 and the second leg 22 from separating. The basket 11 is configured to co-act to support the dowels 40*a*, 40*b*, and 40*c* at or along an area where a contraction joint will be formed.

The manufacturing process of this concrete known apparatus 10 includes numerous steps, is relatively time consuming, and is relatively expensive. This manufacturing process includes first: (1) constructing leg 12 including resistance welding dowel connectors 20*a*, 20*b*, and 20*c* to the members 14 and 16; and (2) constructing leg 22 including resistance welding dowel connectors 30*a*, 30*b*, and 30*c* to the members 24 and 26. This manufacturing process then includes positioning the constructed legs 12 and 22 in a jig stand. This manufacturing process then includes: (1) positioning the leg connectors 60 and 62 on the legs 12 and 22; and (2) positioning the respective dowels 40*a*, 40*b*, and 40*c* under the respective dowel connectors 20*a*, 20*b*, 20*c*, 30*a*, 30*b*, and 30*c*. This manufacturing process then includes: (1) attaching the legs 12 and 22 by welding the leg connectors 60 and 62 to the members 16 and 26 of the respective legs 12 and 22; (2) welding dowel connector 20*b* to the top of the dowel 40*b*; (3) welding dowel connector 30*a* to the top of the dowel 40*a*; and (4) welding dowel connector 30*c* to the top of the dowel 40*c*.

SUMMARY

Various embodiments of the present disclosure provide a concrete slab load transfer apparatus and methods of manufacturing same.

Various embodiments of the present disclosure provide a concrete slab load transfer apparatus that includes (1) a plurality of load transfer dowels each having a top surface and a bottom surface; (2) a basket supporting the load transfer dowels; and (3) a plurality of welds including a plurality of breakable welds connecting the bottom surfaces of the load transfer dowels to the basket. In these embodiments, the basket includes two spaced apart legs that are attached by the load transfer dowels and the welds. This concrete slab load transfer apparatus substantially reduces the components of the concrete slab load transfer apparatus.

Various embodiments of the present disclosure provide a method of manufacturing a concrete slab load transfer apparatus that includes: (1) positioning the plurality of load transfer dowels on a surface; (2) positioning the basket and specifically the legs of the basket above and on the bottom surface of the dowels; and (3) connecting the baskets directly to the bottom surfaces of the load transfer dowels by welds including a plurality of breakable welds. In these embodiments, the method includes attaching two spaced apart legs to the load transfer dowels using the welds including the breakable welds, and thus attaching the two spaced apart legs using the load transfer dowels themselves (instead of the connectors described above). This method of manufacturing the concrete slab load transfer apparatus substantially minimizes the steps for (and the related time expense necessary for) manufacturing the concrete slab load transfer apparatus of the present disclosure.

Additional features and advantages of the present invention are described in, and will be apparent from, the following Detailed Description and the Figures.

DETAILED DESCRIPTION OF EXAMPLE EMBODIMENTS

Figure 1:
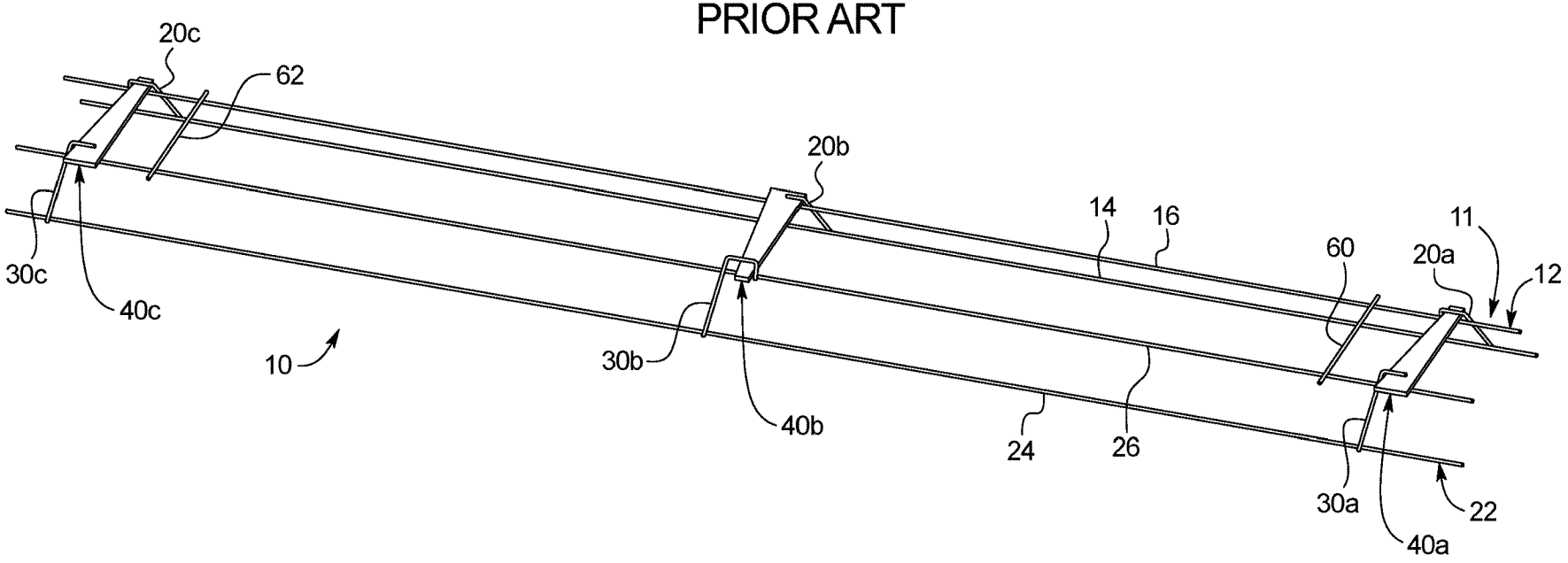
FIG. 1 PRIOR ART
FIG. 1 is a perspective view of a section of a known concrete slab load transfer apparatus.
Figure 2:
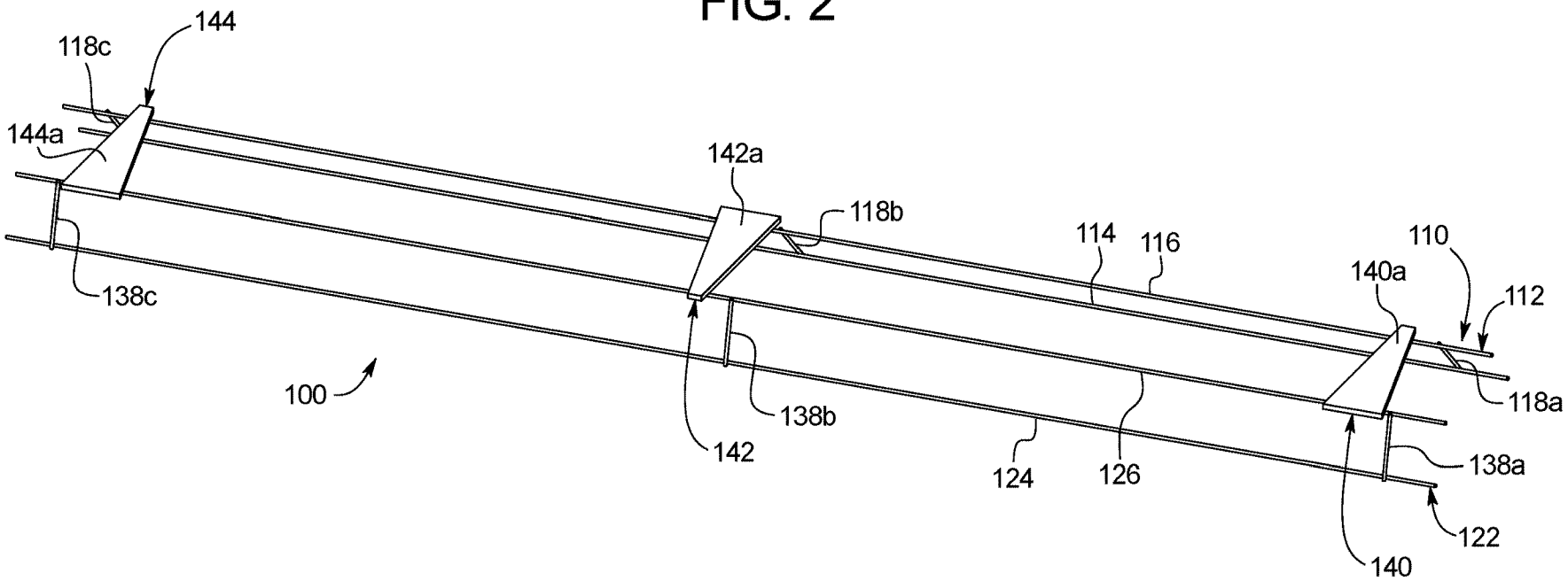
FIG. 2 is a perspective view of an example embodiment of the concrete slab load transfer apparatus of the present disclosure.
Figure 3:
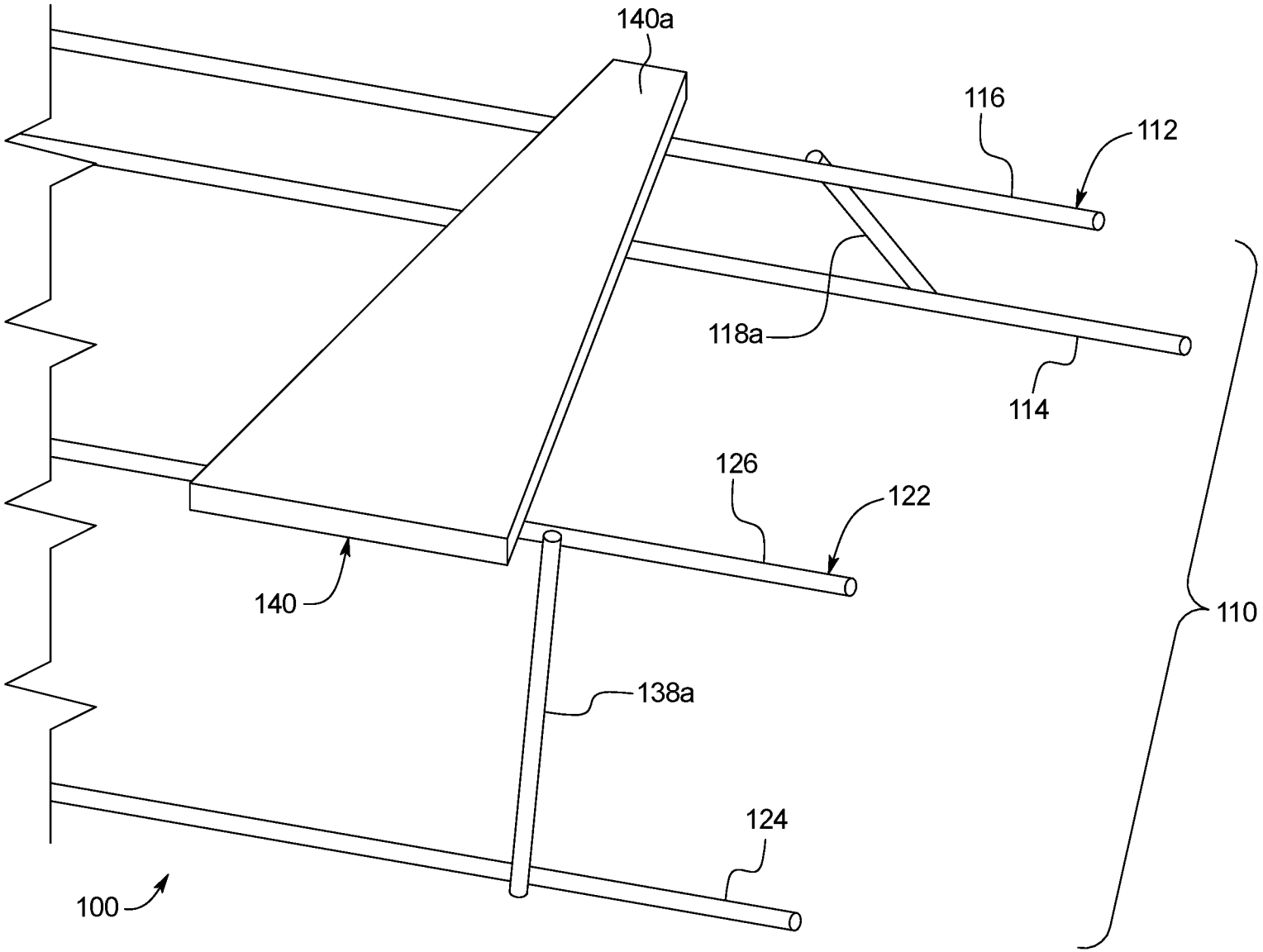
FIG. 3 is an enlarged fragmentary perspective view of one of the load transfer dowels and part of the basket of the concrete slab load transfer apparatus of FIG. 2.
Figure 4:
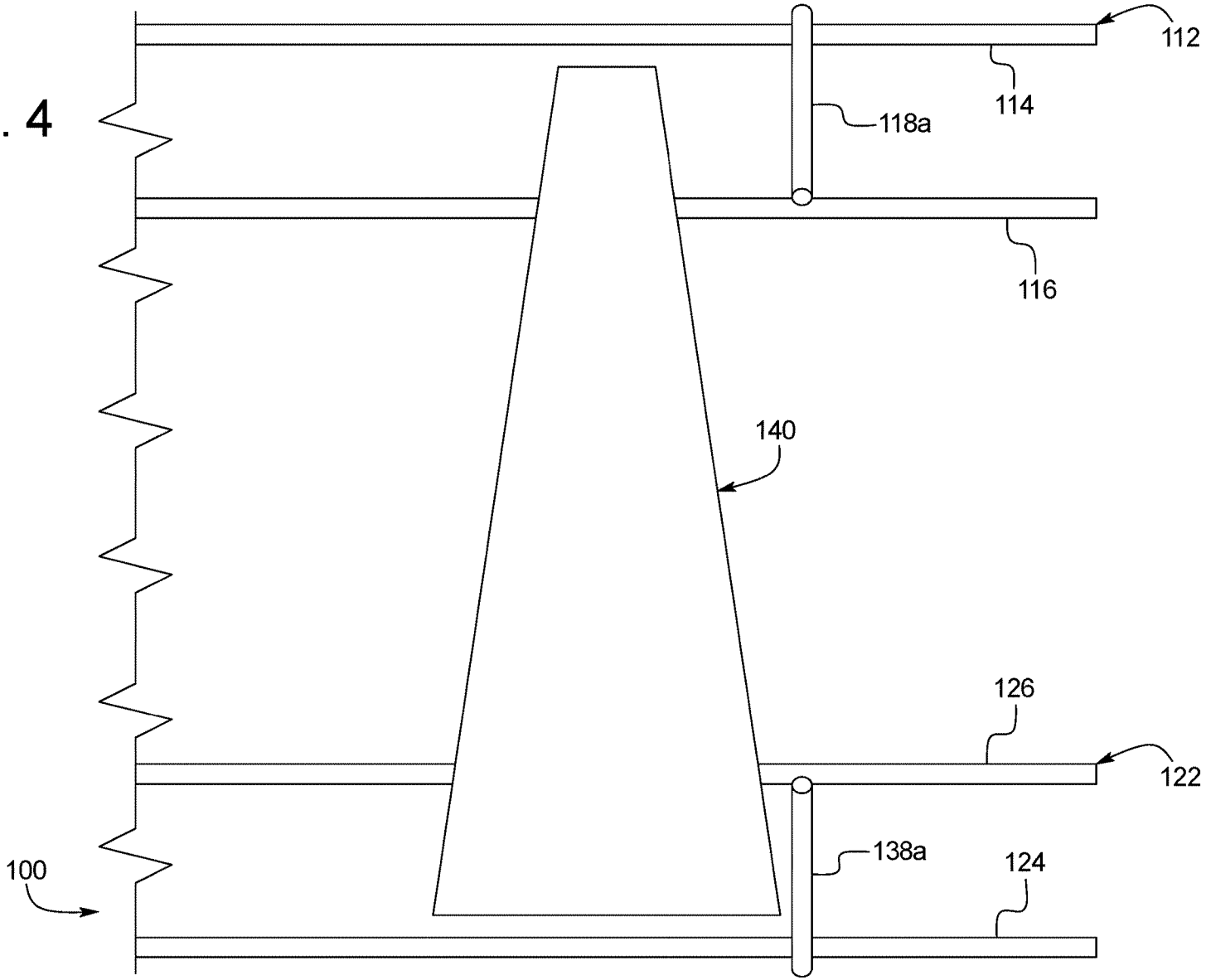
FIG. 4 is an enlarged fragmentary top view of one of the load transfer dowels and part of the basket of the concrete slab load transfer apparatus of FIG. 2.
Figure 5:
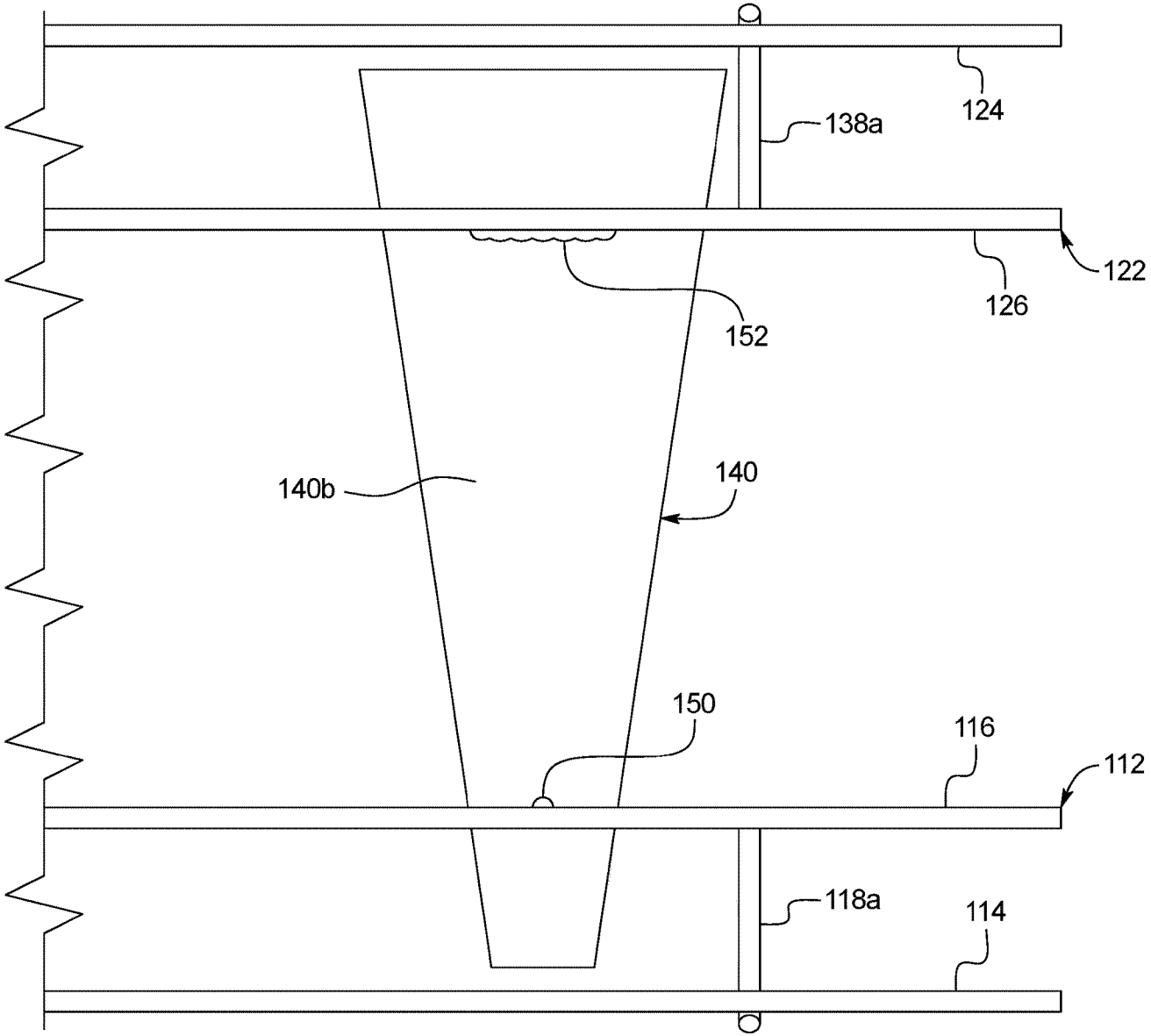
FIG. 5 is an enlarged fragmentary bottom view of one of the load transfer dowels and part of the basket of the concrete slab load transfer apparatus of FIG. 2.
Figure 6:
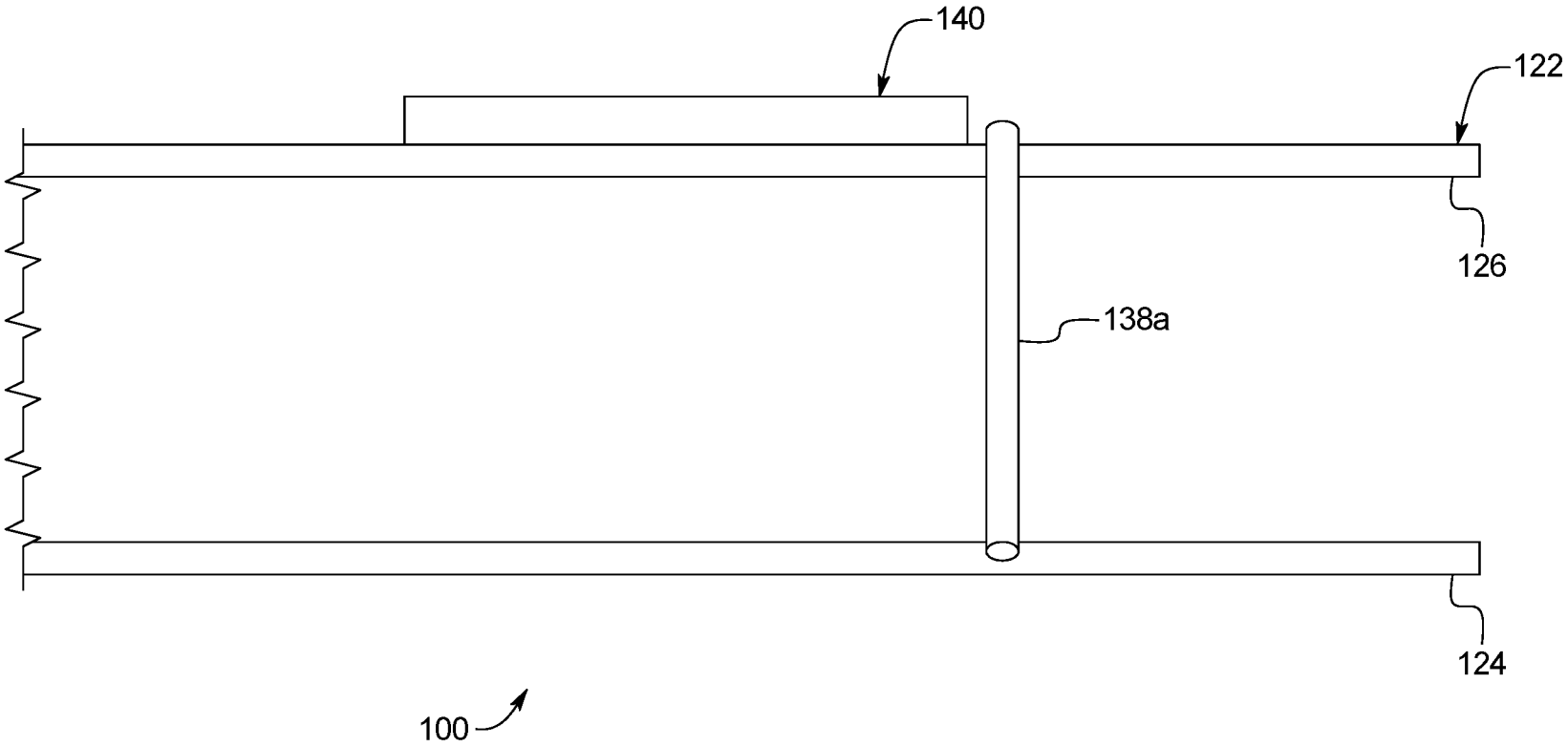
FIG. 6 is an enlarged fragmentary side view of one of the load transfer dowels and the basket of the concrete slab load transfer apparatus of FIG. 2.
Figure 7:
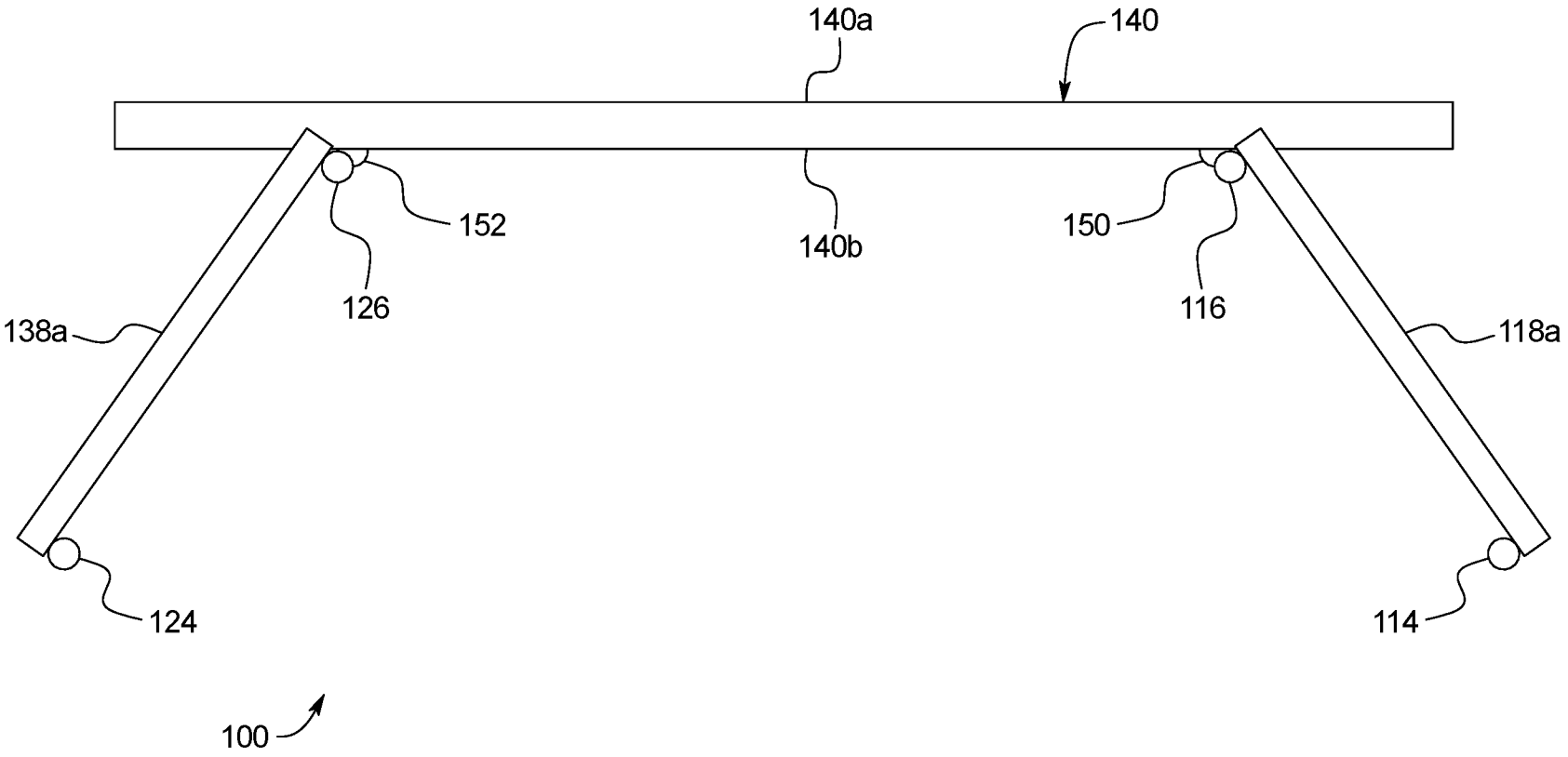
FIG. 7 is an enlarged end view of one of the load transfer dowels and the basket of the concrete slab load transfer apparatus of FIG. 2.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, attached, connected, and the like, are not intended to be limited to direct mounting methods but should be interpreted broadly to include indirect and operably mounted, attached, connected and like mounting methods. This specification is intended to be taken as a whole and interpreted in accordance with the principles of the present disclosure and as understood by one of ordinary skill in the art.

Various embodiments of the present disclosure provide a concrete slab load transfer apparatus and a method of manufacturing same. For brevity, the concrete slab load transfer apparatus may sometimes be referred to herein as the load transfer apparatus or as the apparatus. Such abbreviations are not meant to limit the scope of the present disclosure.

Example Load Transfer Apparatus

One example embodiment of the concrete slab load transfer apparatus is generally illustrated in FIGS. 2, 3, 4, 5, 6, 7, 8, 9, 10, and 11. This example embodiment of the concrete slab load transfer apparatus of the present disclosure is generally indicated by numeral 100.

In this illustrated example embodiment, this concrete slab load transfer apparatus 100 generally includes: (a) a plurality of steel planar load transfer dowels 140, 142, and 144; and (b) a steel basket 110 configured to support the planar load transfer dowels 140, 142, and 144; (c) a plurality of breakable welds 150, 152, and 154 (best seen in FIGS. 5 and 10), that temporarily attach the planar load transfer dowels 140, 142, and 144 to the basket 110; and (d) a plurality of welds 160, 162, and 164 (best seen in FIGS. 5 and 10), that attach the planar load transfer dowels 140, 142, and 144 to the basket 110. The breakable welds 150, 152, and 154 are formed to attach the respective bottom surfaces 140*b*, 142*b*, and 144*b* of the dowels 140, 142, and 144 to the basket 110 such that when the concrete slab load transfer apparatus 100 is positioned at an area where a contraction joint will be formed between two adjacent concrete slabs, the movement of the concrete slabs will cause the narrow ends of the dowels 140, 142, and 144 to break off of or from the basket 110 and function to provide load transfer between the concrete slabs. This example embodiment does not employ connectors other than the dowels to connect for manufacture, transport, or initial installation certain parts of the basket 110.

The basket 110 in this illustrated example embodiment includes a first steel leg 112 and a spaced apart second steel leg 122. The first leg 112 includes an elongated steel lower member 114 and an elongated steel upper member 116. The first leg 112 further includes three spaced apart steel member connectors 118*a*, 118*b*, and 118*c*, respectively integrally connected to and connecting members 114 and 116. Likewise, the second leg 122 includes an elongated steel lower member 124 and an elongated steel upper member 126. The second leg 122 further includes three spaced apart steel member connectors 138*a*, 138*b*, and 138*c* respectively integrally connected to and connecting members 124 and 126. In this illustrated example embodiment, the steel lower member 114, the steel upper member 116, the steel member connectors 118*a*, 118*b*, and 118*c*, the steel lower member 124, the steel upper member 126, and the steel member connectors 138*a*, 138*b*, and 138*c* are all respectively steel rods. It should be appreciated that such members and connectors can be made from other suitable materials.

Figure 11:
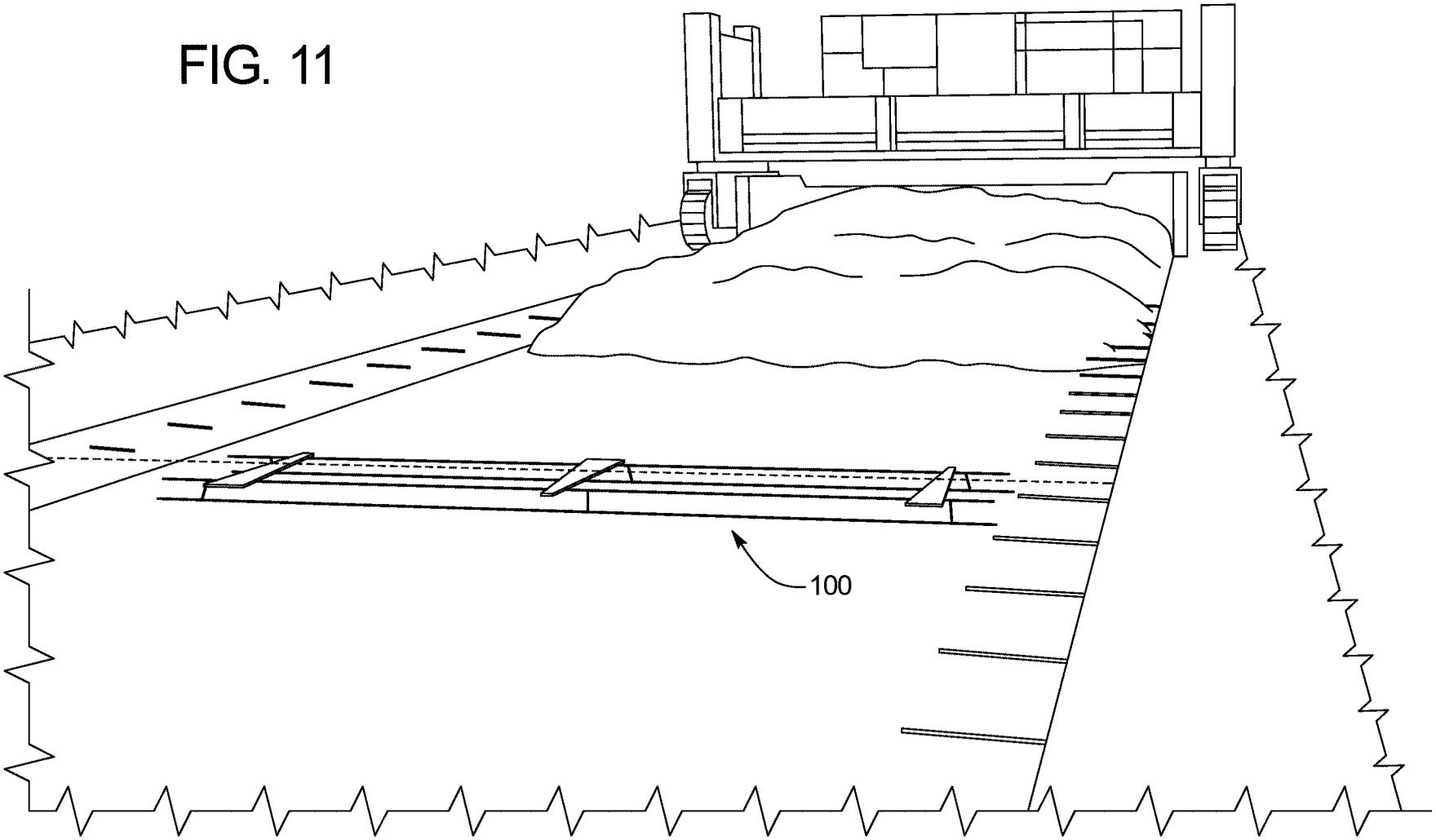
FIG. 11 is a fragmentary perspective view of the concrete slab load transfer apparatus of FIG. 2 positioned in a roadway being constructed and particularly at an area where a contraction joint will be formed.

The first and second legs 112 and 122 are configured to co-act to hold and support the plurality of load transfer dowels 140, 142, and 144 at or along an area where a contraction joint will be formed as generally shown in FIG. 11 and further described below.

The steel planar load transfer dowels 140, 142, and 144 are partly detachably attached to and supported by the basket 110, and specifically partly detachably attached to and supported by the first leg 112 and the second leg 122 in opposing fashion in this illustrated example embodiment. More specifically, in this illustrated example embodiment: (a) the wider end of the tapered load transfer dowel 140 is supported by and welded to the upper member 126; (b) the narrower end of the tapered load transfer dowel 140 is supported by and spot welded to the upper member 116; (c) the narrower end of the tapered load transfer dowel 142 is supported by and spot welded to the upper member 126; (d) the wider end of the tapered load transfer dowel 142 is supported by and welded to the upper member 116; (e) the narrower end of the tapered load transfer dowel 144 is supported by and spot welded to the upper member 116; and (f) the wider end of the tapered load transfer dowel 144 is supported by and welded to the upper member 126. The dowels 140, 142, and 144 thus hold the legs 112 and 122 in the desired space apart relation until the dowels 140, 142, and 144 break off (at the breakable welds) from the legs 112 and 122 when in use. This eliminates the need for the leg connectors 60 and 62 of the apparatus shown in FIG. 1.

It should be appreciated that the directions of the respective tapers of the load transfer dowels 140, 142, and 144 alternate from one tapered load transfer dowel to the adjacent tapered load transfer dowel. For contraction joints, if the center of the contraction joint ends up positioned somewhat off-center relative to these tapered load transfer dowels 140, 142, and 144, the alternating pattern of tapered load dowels 140, 142, and 144 compensates for this misalignment.

In this illustrated embodiment, each of the tapered load transfer dowels 140, 142, and 144 has a top tapered planar surface (respectively, surfaces 140*a*, 142*a*, and 144*a*) and a bottom tapered planar surface (respectively, surfaces 140*b*, 142*b*, and 144*b*). The top and bottom flat surfaces are substantially parallel to one another in this illustrated example embodiment. In this illustrated example embodiment, the top and bottom surfaces taper from approximately 4 inches wide to a narrow end approximately 1 inch wide over a length of approximately 12 inches. The advantages provided by and load transfer operation of these tapered load transfer dowels are described in U.S. Pat. Nos. 7,716,890, 7,481,031, and 8,381,470.

It should be appreciated that the other suitable tapered shapes and/or other suitable shapes and sizes for the dowels may also be employed in accordance with the present disclosure.

The plurality of member connectors 118*a*, 118*b*, 118*c*, 138*a*, 138*b*, and 138*c* of the load transfer apparatus 100 are respectively integrally connected to (such as by welding) the legs 112 and 122 of the basket 110. More specifically, each member connector 118*a*, 118*b*, and 118*c* includes a relatively short generally cylindrical rod having two opposing ends integrally respectively attached to the upper member 116 and the lower member 114 of the leg 112 of the basket 110. Likewise, each member connector 138*a*, 138*b*, and 138*c* includes a relatively short generally cylindrical rod having two opposing ends integrally respectively attached to the upper member 126 and the lower member 124 of the leg 122 of the basket 110.

It should thus be appreciated from the above and as shown in FIG. 11 that in this illustrated example embodiment of present disclosure, each concrete slab load transfer apparatus 100 is configured to be used or positioned such that the load transfer dowels 140, 142, and 144 of that apparatus 100 are positioned for load transfer at an area where a contraction joint will be formed between adjacent concrete slabs for connecting and transferring loads between the adjacent concrete slabs.

It should be appreciated that in this example embodiment, no other members or components connect the two legs 112 and 122 besides the dowels and the breakable welds. In other words, the two legs 112 and 122 are only connected by the dowels and the welds including the breakable welds in various example embodiments of the present disclosure.

In other example embodiments of the present disclosure, suitable clips such as suitable plastic clips are employed to at least partially attach the upper members 116 and 126 to the load transfer dowels 140, 142, and 144. In one such example embodiment, suitable clips such as suitable plastic clips are employed to attach the upper members 116 and 126 to the narrower ends of the load transfer dowels 140, 142, and 144. In one such example embodiment, suitable clips such as suitable plastic clips are employed to attach the upper members 116 and 126 to the wider ends of the load transfer dowels 140, 142, and 144. In one such example embodiment, suitable clips such as suitable plastic clips are employed to attach the upper members 116 and 126 to the wider and narrower ends of the load transfer dowels 140, 142, and 144.

It should thus be appreciated that the present disclosure includes leg to basket connectors that can be in numerous different forms such as the welds, the breakable welds, and the clips.

In the illustrated example embodiment, (a) the load transfer dowels are steel; and (b) the components of the basket are steel. It should be appreciated that one or more of these components can be made from other suitable materials in accordance with the present disclosure.

It should also be appreciated that one or more of: (a) the plurality of load transfer dowels; and/or (b) the basket can be made in other suitable sizes, shapes, and configurations in accordance with the present disclosure.

It should also be appreciated that the quantity of load transfer dowels may vary in accordance with the present disclosure.

Example Manufacturing Method

Figure 8:
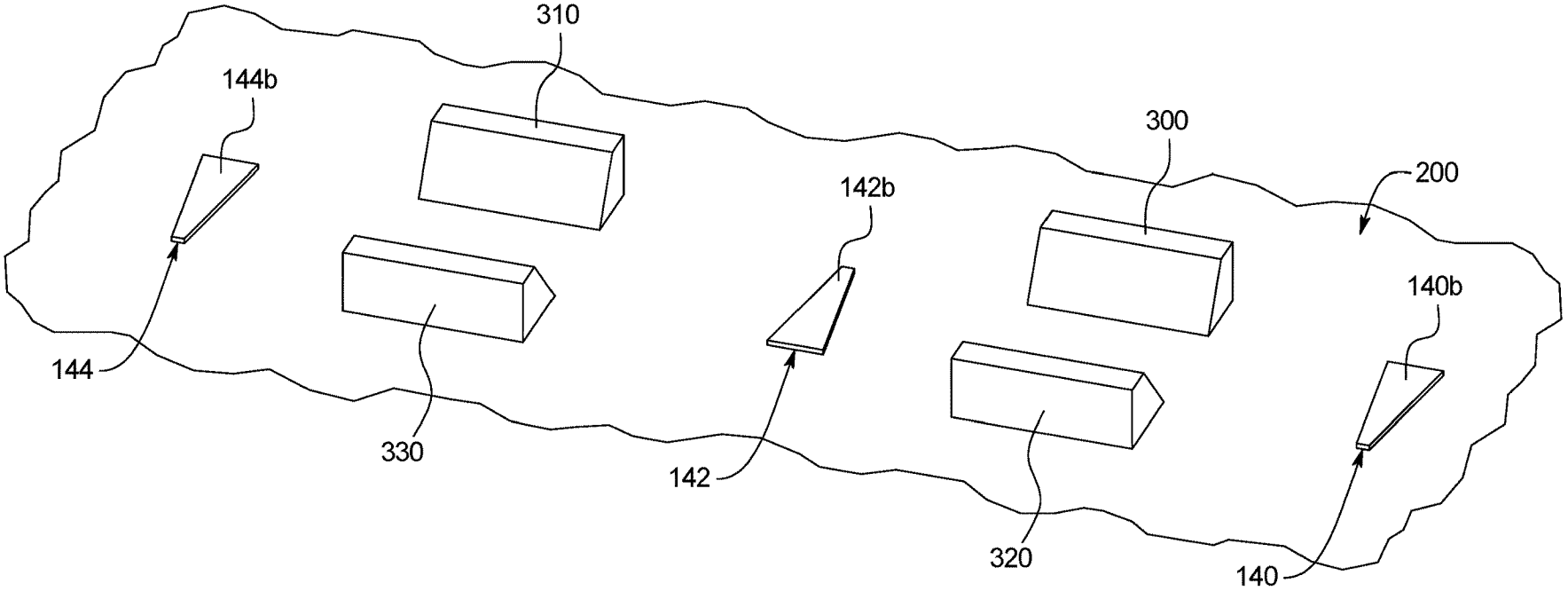
FIGS. 8, 9, and 10 are diagrammatic perspective views of a method of manufacturing the concrete slab load transfer apparatus of FIG. 2.
Figure 9:
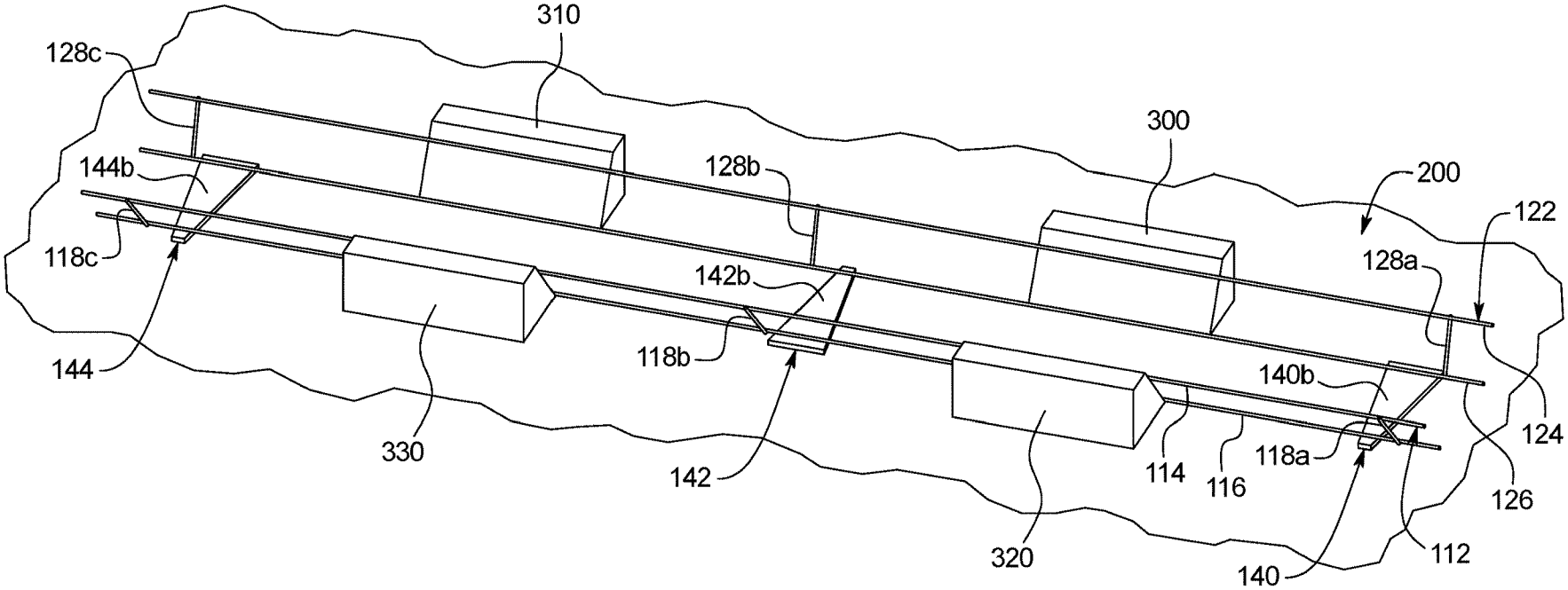
Figure 10:
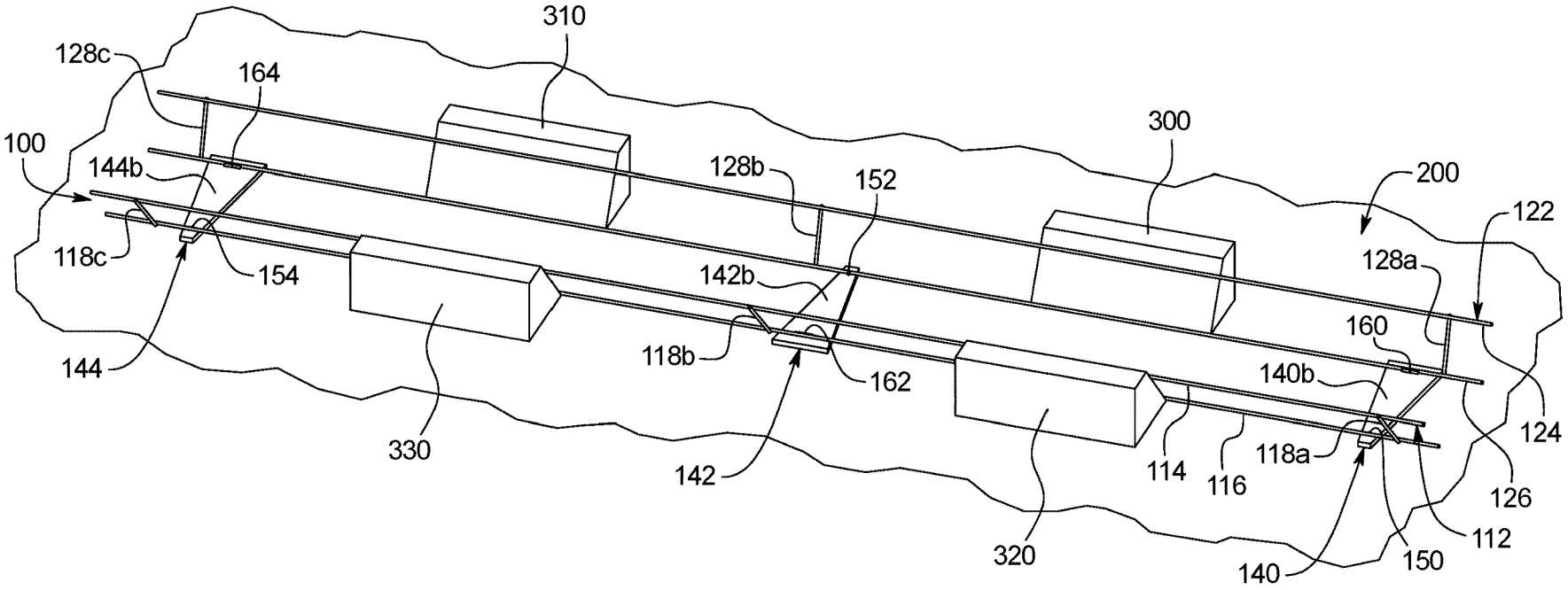

Referring now specifically to FIGS. 8, 9, and 10, one example embodiment of a method of manufacturing the concrete slab load transfer apparatus 100 of the present disclosure is generally shown. In this illustrated example embodiment, the apparatus 100 is built in an upside down position and then inverted for transport and use (even though transport can be in the upside down position). This illustrated example embodiment of the method generally includes: (a) positioning a plurality of load transfer dowels 140, 142, and 144 upside down on a surface 200 as generally shown in FIG. 8; (b) positioning the individual legs 112 and 122 of the basket 110 above and on the bottom surfaces of dowels 140, 142, and 144 as generally shown in FIG. 9; and (c) forming suitable welds between the top members 116 and 126 of the legs 112 and 122 to connect the legs 112 and 122 to the dowels 140, 142, and 144 and to connect the two legs 112 and 122 together as generally shown in FIG. 10.

More specifically, this illustrated example method includes positioning the desired quantity of load transfer dowels such as load transfer dowels 140, 142, and 144 upside down on a surface 200 (such as on a surface of a table) as generally shown in FIG. 8. This illustrated example method includes alternating the directions of the dowels 140, 142, and 144 for the purposes described above.

This illustrated example method includes forming the leg 112 from member 114, member 116, and members 118*a*, 118*b*, and 118*c*. In this illustrated example embodiment, this is done separately and includes positioning the members 114 and 116 and welding the members 118*a*, 118*b*, and 118*c* to members 114 and 116. This illustrated example method includes positioning the leg 112 above and on the bottom surfaces of dowels 140, 142, and 144 as generally shown in FIG. 9. As illustrated in FIG. 10, this illustrated example method further includes: (a) forming a breakable spot weld 150 attaching member 116 to the bottom surface 140*b* of dowel 140; (b) forming a line weld 162 attaching member 116 to the bottom surface 142*b* of dowel 142; and (c) forming a breakable spot weld 154 attaching member 116 to the bottom surface 144*b* of dowel 144.

This illustrated example method includes forming the leg 122 from member 124, member 126, and members 128*a*, 128*b*, and 128*c*. In this illustrated example embodiment, this is done separately and includes positioning the members 124 and 126 and welding the members 128*a*, 128*b*, and 128*c* to members 124 and 126. This illustrated example method includes positioning the leg 122 above and on the bottom surfaces of dowels 140, 142, and 144 as generally shown in FIG. 9. As illustrated in FIG. 10, this illustrated example method further includes: (a) forming a line weld 160 attaching member 126 to the bottom surface 140*b* of dowel 140; (b) forming a breakable spot weld 152 attaching member 126 to the bottom surface 142*b* of dowel 142; and (c) forming a line weld 164 attaching member 126 to the bottom surface 144*b* of dowel 144.

This illustrated example method includes forming breakable spot welds and the line welds between the top members 116 and 126 of the legs 112 and 122 and the dowels 140, 142, and 144 to connect the legs 112 and 122 to the dowels 140, 142, and 144 and to connect the two legs 112 and 122 together for storage, transport and initial installation. These welds attach the members 116 and 126 and the respective bottom surfaces 140*a*, 142*a*, and 144*a* of the load transfer dowels 140, 142, and 144 and, and breakable spot welds 150, 152, and 154 are configured to be broken during use of the load transfer apparatus 100, and particularly when the concrete slabs cause the dowels 140, 142, and 144 to move. In other words, while the spot welds 150, 152, and 154 are strong enough to hold their connections during storage, transport, and installation of the apparatus 100, the spot welds 150, 152, and 154 are configured to purposely fail in the concrete joint during movement of the concrete slabs.

In this illustrated example embodiments, the jig members 300, 310, 320, and 330 are used to temporarily support the legs during the manufacturing process prior to the welds being formed. It should be appreciated that any suitable jig members can be employed for this manufacturing process in accordance with the present disclosure. It should also be appreciated that other suitable breakable or otherwise disconnectable attachment mechanisms can be employed instead of the breakable welds.

It should thus be appreciated from the above that various embodiments of the present disclosure provide a concrete slab load transfer apparatus comprising: a plurality of load transfer dowels each having a top surface and a bottom surface; a basket supporting the load transfer dowels; and a plurality of welds including a plurality of breakable welds connecting the bottom surfaces of the load transfer dowels to the basket.

In various such embodiments of the concrete slab load transfer apparatus, the basket includes a first leg and a second leg.

In various such embodiments of the concrete slab load transfer apparatus, the first leg includes an elongated lower member, an elongated upper member, and a plurality of spaced apart member connectors connecting the lower and upper members.

In various such embodiments of the concrete slab load transfer apparatus, the second leg includes an elongated lower member, an elongated upper member, and a plurality of spaced apart member connectors connecting the lower and upper members.

In various such embodiments of the concrete slab load transfer apparatus, the plurality of welds connect the bottom surfaces of the load transfer dowels to the elongated upper member of the first leg and the elongated upper member of the second leg.

In various such embodiments of the concrete slab load transfer apparatus, one or more of the breakable welds are spot welds.

In various such embodiments of the concrete slab load transfer apparatus, one or more of the breakable welds are spot welds.

In various such embodiments of the concrete slab load transfer apparatus, for a first one of the load transfer dowels, one of the welds attaching the load transfer dowel to the first leg is a breakable spot weld and one of the welds attaching the load transfer dowel to the second leg is a line weld.

In various such embodiments of the concrete slab load transfer apparatus, for a second one of the load transfer dowels, one of the welds attaching the load transfer dowel to the first leg is a line weld and one of the welds attaching the load transfer dowel to the second leg is a breakable spot weld.

It should also thus be appreciated from the above that various embodiments of the present disclosure provide a concrete slab load transfer apparatus comprising: a plurality of load transfer dowels each having a top surface and a bottom surface; a basket supporting the load transfer dowels; and a plurality of connections connecting the bottom surfaces of the load transfer dowels to the basket, said plurality of connections including a plurality of breakable connections.

It should also thus be appreciated from the above that various embodiments of the present disclosure provide a method of manufacturing a concrete slab load transfer apparatus, said method comprising: (a) positioning the plurality of load transfer dowels on a surface; (b) positioning the basket and specifically first and second legs of the basket above and adjacent to the load transfer dowels; and (c) attaching the legs to the load transfer dowels by a plurality of welds including a plurality of breakable welds.

In various such embodiments, the method includes positioning the first and second legs adjacent to bottom surfaces of the load transfer dowels before forming the welds.

In various such embodiments of the method, one or more of the breakable welds are spot welds.

In various such embodiments of the method, for a first one of the load transfer dowels, one of the welds attaching the load transfer dowel to the first leg is a breakable spot weld and one of the welds attaching the load transfer dowel to the second leg is a line weld.

In various such embodiments of the method, for a second one of the load transfer dowels, one of the welds attaching the load transfer dowel to the first leg is a line weld and one of the welds attaching the load transfer dowel to the second leg is a breakable spot weld.

Various changes and modifications to the above-described embodiments described herein will be apparent to those skilled in the art. These changes and modifications can be made without departing from the spirit and scope of this present subject matter and without diminishing its intended advantages.

The invention is claimed as follows:

1. A concrete slab load transfer apparatus comprising:
a plurality of load transfer dowels each having a top surface and a bottom surface;
a basket supporting the load transfer dowels, the basket including a first leg and a second leg; and
a plurality of welds connecting the load transfer dowels to the first leg and to the second leg of the basket, wherein for each of the load transfer dowels, the welds include a breakable weld attaching that load transfer dowel to one of the first and second legs, and a stronger weld attaching that load transfer dowel to the other of the first and second legs.

2. The concrete slab load transfer apparatus of claim 1, wherein each of the load transfer dowels are only attached to the first and second legs by the welds.

3. The concrete slab load transfer apparatus of claim 2, wherein the first leg includes an elongated first lower member, an elongated first upper member, and a first plurality of spaced apart member connectors connecting the elongated first lower member and the elongated first upper member.

4. The concrete slab load transfer apparatus of claim 3, wherein the second leg includes an elongated second lower member, an elongated second upper member, and a second plurality of spaced apart member connectors connecting the elongated second lower member and the elongated second upper member.

5. The concrete slab load transfer apparatus of claim 4, wherein the plurality of welds including the breakable welds connect the bottom surfaces of the load transfer dowels to the elongated first upper member of the first leg and the elongated second upper member of the second leg.

6. The concrete slab load transfer apparatus of claim 1, wherein each of the breakable welds attaching the load transfer dowels to the first leg of the basket enables separation of that load transfer dowel from the first leg of the basket after installation of the concrete slab load transfer apparatus.

7. The concrete slab load transfer apparatus of claim 6, wherein each of the breakable welds attaching the load transfer dowels to the second leg of the basket enables separation of that load transfer dowel from the second leg of the basket after installation of the concrete slab load transfer apparatus.

8. The concrete slab load transfer apparatus of claim 7, wherein for a first one of the load transfer dowels, the breakable weld attaching said first load transfer dowel to the first leg is a breakable spot weld and the weld attaching said first load transfer dowel to the second leg is a different weld.

9. The concrete slab load transfer apparatus of claim 8, wherein for a second one of the load transfer dowels, the breakable weld attaching said second load transfer dowel to the second leg is a breakable spot weld and the weld attaching said second load transfer dowel to the first leg is a different weld.

10. A concrete slab load transfer apparatus comprising:
a basket including a first leg and a second leg; and
a plurality of load transfer dowels each having a top surface and a bottom surface, wherein each of the plurality of load transfer dowels is attached to: (a) one of the first leg and the second leg by a breakable first spot weld; and (b) the other one of the first leg and the second leg by a stronger second weld.

11. The concrete slab load transfer apparatus of claim 10, wherein each of the plurality of load transfer dowels is only attached to the first leg and the second leg by the respective breakable first spot weld and the respective second weld.

12. The concrete slab load transfer apparatus of claim 10, wherein each of the breakable first spot welds attaching one of the load transfer dowels to one of the first and second leg of the basket enable separation of that load transfer dowel from that leg of the basket after installation.

13. The concrete slab load transfer apparatus of claim 10, wherein for a first one of the load transfer dowels, the breakable first spot weld attaches the first load transfer dowel to the first leg.

14. The concrete slab load transfer apparatus of claim 13, wherein for a second one of the load transfer dowels, the breakable first spot weld attaches the second load transfer dowel to the second leg.

15. The concrete slab load transfer apparatus of claim 10, wherein the second welds are line welds.

16. A method of manufacturing a concrete slab load transfer apparatus, said method comprising:
positioning a plurality of load transfer dowels on a support, the plurality of load transfer dowels each having a first end and a second end;
positioning first and second legs of a basket above and adjacent to the plurality of load transfer dowels; and
attaching the first and second legs to each of the plurality of load transfer dowels using, for each of the plurality of load transfer dowels, a breakable spot weld and a second weld, and which includes, for a first one of the load transfer dowels, forming the breakable spot weld to attach the first load transfer dowel to the first leg and forming the second weld as a line weld to attach the first load transfer dowel to the second leg.

17. The method of claim 16, which includes positioning the first and second legs adjacent to bottom surfaces of the load transfer dowels before forming the welds.

18. The method of claim 16, which includes, for each of the load transfer dowels, forming the breakable spot weld to attach that load transfer dowel to one of the first and second legs of the basket to enable separation of that load transfer dowel from that leg of the basket after installation.

19. The method of claim 16, which includes, for a second one of the load transfer dowels, forming the second weld as a line weld to attach the second load transfer dowel to the first leg and forming the breakable spot weld to attach the second load transfer dowel to the second leg.

* * * * *